US005109621A

United States Patent [19]

Blaser

[11] Patent Number: 5,109,621

[45] Date of Patent: May 5, 1992

[54] CARTRIDGE EJECTION DEVICE

[75] Inventor: Horst Blaser, Isny im Allgäu, Fed. Rep. of Germany

[73] Assignee: Dynamit Nobel Aktiengesellschaft, Troisdorf, Fed. Rep. of Germany

[21] Appl. No.: 640,873

[22] Filed: Jan. 14, 1991

[30] Foreign Application Priority Data

Jan. 13, 1990 [DE] Fed. Rep. of Germany ..... 4000816

[51] Int. Cl.[5] ..... F41A 15/06

[52] U.S. Cl. ..... 42/46; 42/47

[58] Field of Search ..... 42/46, 47

[56] References Cited

U.S. PATENT DOCUMENTS

| | | | |
|---|---|---|---|
| 2,641,077 | 6/1953 | Foote et al. | 42/46 |
| 3,964,198 | 6/1976 | Waddell | 42/46 |
| 4,516,345 | 5/1985 | Flodman | 42/47 |

FOREIGN PATENT DOCUMENTS

| | | | |
|---|---|---|---|
| 8203452 | 10/1982 | World Int. Prop. O. | 42/47 |

*Primary Examiner*—Michael J. Carone

*Attorney, Agent, or Firm*—Antonelli, Terry, Stout & Kraus

[57] ABSTRACT

The reliability of a cartridge ejection device can be improved by the interposition of a readily deactivatable control flap, arranged on the outside of a monobloc unit, between a control bolt and a cartridge ejector of a break-open gun-housing of at least one barrel. The arrangement has the advantage wherein when no shot has been fired, the ejector will move into the extended position gradually during tilting of the barrel. When a shot has been fired, the ejector will remained tensioned until the barrel has been entirely tilted. Another advantageous feature is obtained by constructing the cartridge ejector of two parts coupled by way of a spring, namely a cartridge extractor and an extractor element, because thereby stress peaks can be further reduced and the cartridge extractor can already be entirely in the retracted position even before the barrel is completely closed.

10 Claims, 6 Drawing Sheets

FIG. 3
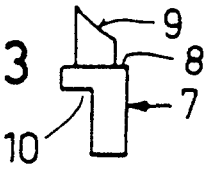
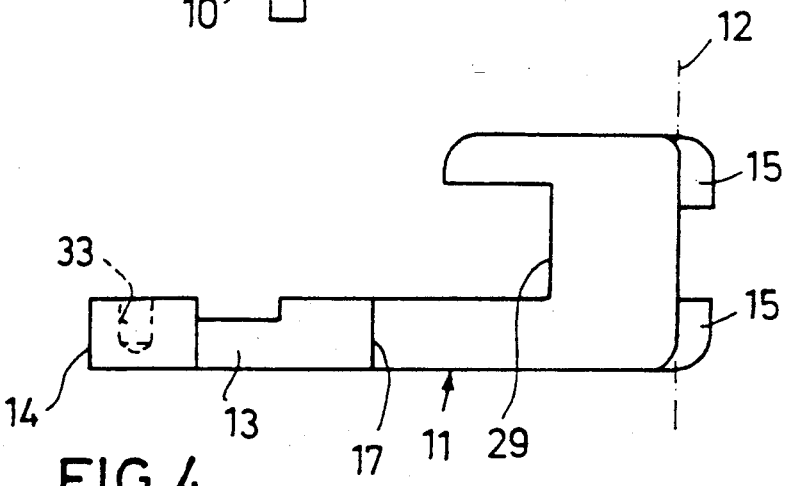
FIG. 4
FIG. 5A
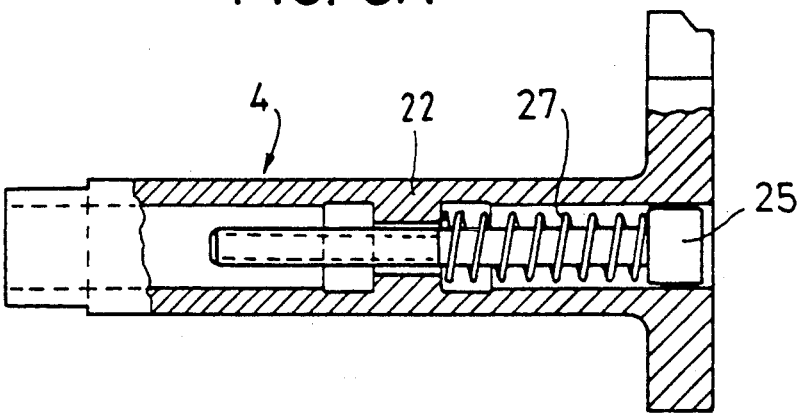
FIG. 5B
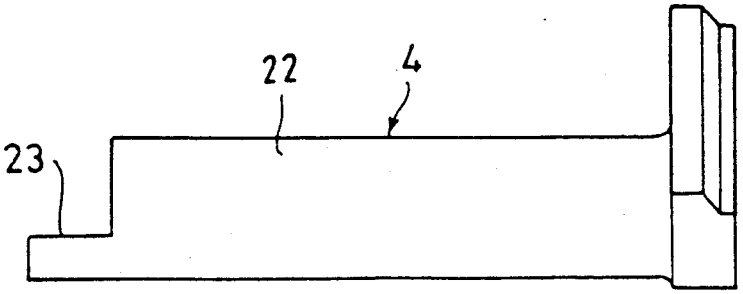

CARTRIDGE EJECTION DEVICE

BACKGROUND OF THE INVENTION

This invention relates to a break-open firearm with at least one barrel and a cartridge ejection device in a monobloc unit, exhibiting per barrel a cartridge ejector movable in the barrel direction, this cartridge ejector, during tilting of the barrel, being movable via a cam at the cartridge extractor and by an appropriate guidance of the cam in the breech casing from a retracted position into a protruding position, and performing, during straightening (i.e., closing), a reverse movement wherein, during straightening of the barrel, an ejector spring can be tensioned at the same time, and, per barrel, a control bolt is provided extending through the barrel wall and effecting, after a shot has been fired, that the cartridge ejector during tilting remains in a tensioned position, and the tensioned position can be abolished only when the at least one barrel has been entirely tilted.

Such firearms, including rifles and shotguns, besides being used in hunting, are utilized predominantly in shooting which simulates hunting; they are exposed to very high stresses on account of the high number of rounds that are fired. The parts of the cartridge ejector mechanism ar especially affected in this regard. Primarily for reasons of space, the parts cannot be dimensioned as would be necessary from a stress viewpoint. If the cartridge ejector mechanism is controlled by way of the triggering process, it may happen—because after termination of a hunt or a competition the springs of the strikers are relaxed due to an empty strike without cartridges—that during the subsequent opening of the firearm the ejector mechanism is activated. This is disadvantageous for the firearm because the cartridge ejector mechanism, on account of lack of cartridges, need not perform any energy-consuming work and for this reason there are high tension peaks.

In EP 103,568, B1, the mechanical a control of the ejector device by the trigger mechanism is substituted by a control via the gas pressure produced during the firing of a cartridge in the cartridge chamber. In such a firearm, a control bolt is countersunk into the wall of each barrel, this bolt being moved somewhat toward the outside by the expanding case wall, and this minimal movement of the control bolt has the effect that the tip of the control bolt can engage in a shape-mating fashion in the cartridge extractor and maintain the latter in a tensioned condition. By operating an ejector pawl at the end of the tilting of the barrel, this connection is eliminated and the impulse, transmitted thereby suddenly from a tensioned spring to the ejector mechanism, is utilized for the ejection of the cartridge case.

The cartridge ejector device described in EP 103,568 B1 has the drawback that, in the practical realization of this idea, other disadvantages had to be tolerated. The control of the tensioning means is accommodated between the barrel and the cartridge extractor, which is extremely unsatisfactory from the viewpoint of manufacturing technique. The slight movement of the control bolt in the barrel wall by only a few tenths of a millimeter also has an adverse effect on reliability, especially since readjustment or a reworking operation is impossible in this structure.

SUMMARY OF THE INVENTION

It is an object of the invention to mitigate the aforementioned disadvantages and to increase the service life and reliability of the firearm.

The invention concerns a break-open firearm as heretofore initially described, characterized in that a control flap with a detent is provided which is mounted to the outside of a monobloc unit, that the control flap can be moved about an axis transversely to the barrel direction, the control bolt not being in engagement with the cartridge ejector but rather, after a shot has been fired, lifting the control flap so that, with the control bolt in the extended position, the detent at the control flap abuts against an edge on the cartridge ejector and thereby the cartridge ejector initially remains in the tensioned position during further tilting of the at least one barrel; whereas, when the control flap is not extended, the movement of the cartridge extractor is not impeded.

A decisive aspect of the invention resides in that the control bolt does not act directly from the barrel side on the cartridge ejector but rather that there is provided, in addition to the control bolt, a control flap readily accessible from the outside, the switching path of which flap can be lengthened on account of the lever effect with respect to the movement of the control bolt, wherein this control member can be handled substantially more advantageously from a manufacturing viewpoint whereby the reliability of the firearm is enhanced. The movement of the forward edge of the detent on the control flap takes place in the same direction as the movement of the control bolt.

In accordance with an especially preferred embodiment of the invention, the cartridge ejector is made up of two parts wherein the ordinary expression cartridge extractor is utilized for the part of the cartridge ejector engaging the cartridge rim and the second part of the cartridge ejector, taking over the control of the cartridge extractor, is denoted as the extractor element.

This bipartite structure of the cartridge ejector affords various advantages. The cartridges extractor can be guided in a round bore. There is adequate space in the monobloc unit for such a bore, and no weakening of the monobloc unit is incurred by such a guidance, either. With a round guide means, the cartridge extractor can be designed identical for each barrel; merely the extractor elements are different, depending on the barrel side on which they are inserted. The protection from twisting of the cartridge extractor can be taken over by the extractor element, since the extractor element is secured against twisting by grooves. Advantageously, the radial guidance of the cartridge extractor is provided by two mutually facing longitudinal surfaces on the extractor element and on the cartridge extractor, the surfaces permitting a change in the mutual distance of the cartridge extractor and extractor element, as will be described below.

In accordance with a special embodiment, the cartridge extractor and the extractor element are coupled via a spring; the path the cartridge extractor can be the same as or smaller than the path of the extractor element positively guided by cams. In this way, it can be ensured that the cartridge extractor is entirely retracted even prior to termination of the closing step, and the cartridge can slide without pressure stress through the breech casing into the cartridge chamber.

Moreover, the spring reduces the shock-like stress on the cartridge extractor and accordingly enhances the service life and reliability of the firearm. The ejector spring is ordinarily covered by the front stock. The cartridge ejector is already entirely retracted by a control cam over the control cam route in the breech casing before the barrels are titled into the breech casing. During the remaining course of closing of the barrels, the spring is tensioned or compressed between the extractor element and the cartridge extractor, depending on whether it is designed as a tension or compression spring. No overstresses occur at the cartridge extractor, already fully retracted, and at the extractor element positively moved by the cams.

The control bolt is secured by a stepped design against excessive penetration into the barrel and against dropping out, as well as against twisting.

The ejector spring which is tensioned when the barrels are straightened preferably is no longer to act on the cartridge ejector once the cartridge ejector has traversed 80–90% of its route. Preferably, damping elements should also be provided at the pressure bolt acted upon by the ejector spring, or at the extractor element, in order to dampen noise In a preferred embodiment, the movement of the control flap is likewise attenuated, preferably by a rubber or synthetic resin ring at the cam of the extractor element.

One embodiment is characterized in that the control flap is guided by tangs and grooves to be movable at the monobloc unit in a hinge-type fashion.

Another advantageous embodiment is characterized in that a tap bolt accessible from the outside is provided at the monobloc unit; when this bolt has been entirely threaded into place, movement of the control flap can be prevented by the control bolt. In this way, the ejector automatic can be simply shut off.

A further advantageous development of the invention is characterized in that a spring presses from the direction of the monobloc unit against the control flap. In this way, the control device can be rendered "sluggish" whereby the reliability can be still further improved because lifting of the control flap without a shot having been fired can thus be precluded with certainty.

In an advantageous further development of the invention, the cartridge extractors and their guide means are designed, in case of multiple-barrel firearms, so that a uniform model can be utilized for each barrel.

BRIEF DESCRIPTION OF THE DRAWINGS

Embodiments of the invention are illustrated in the accompanying drawings and are described in greater detail with reference to the detailed description of the invention. In the drawings:

FIG. 3 shows a control bolt in cross section;

FIG. 4 shows a view of the control flap;

FIGS. 5A and 5B show two views of the cartridge extractor, FIG. 5A being partially in section;

DETAILED DESCRIPTION OF THE INVENTION

Figure 1:
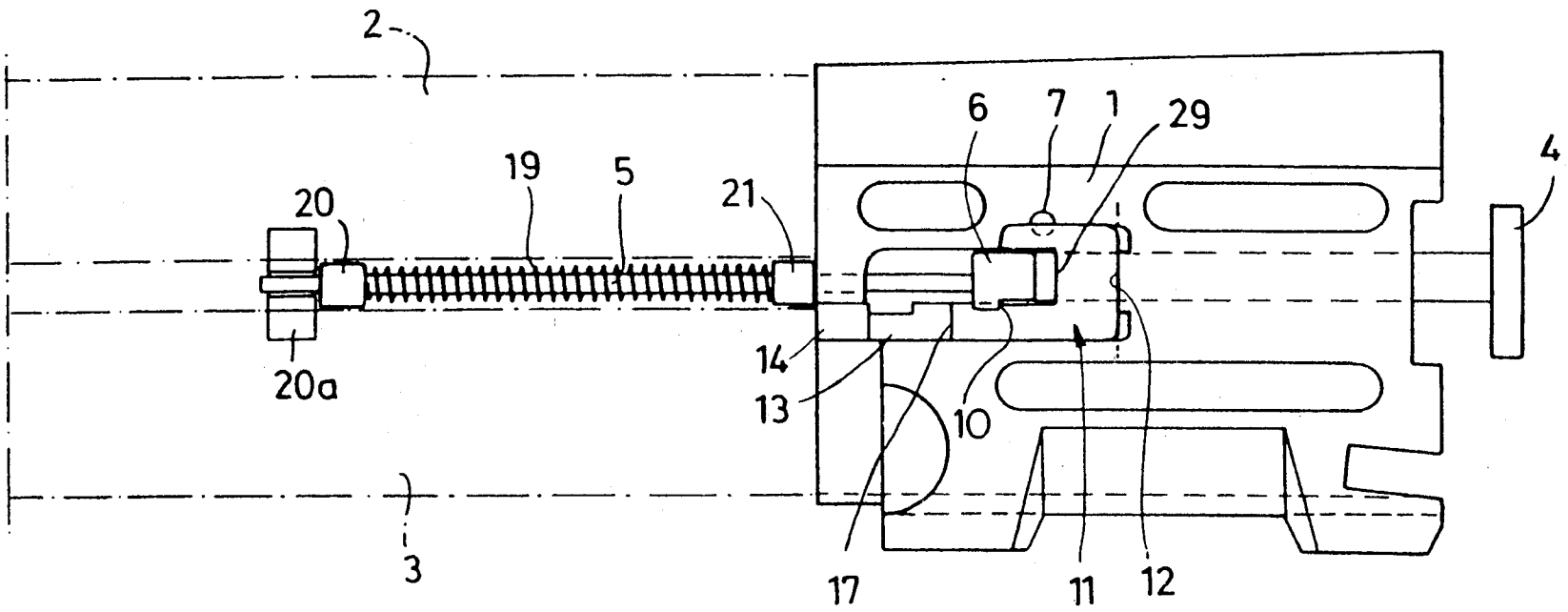
FIG. 1 is a lateral view of the monobloc unit with a cartridge ejector device with the barrels being completely tilted.
Figure 2:
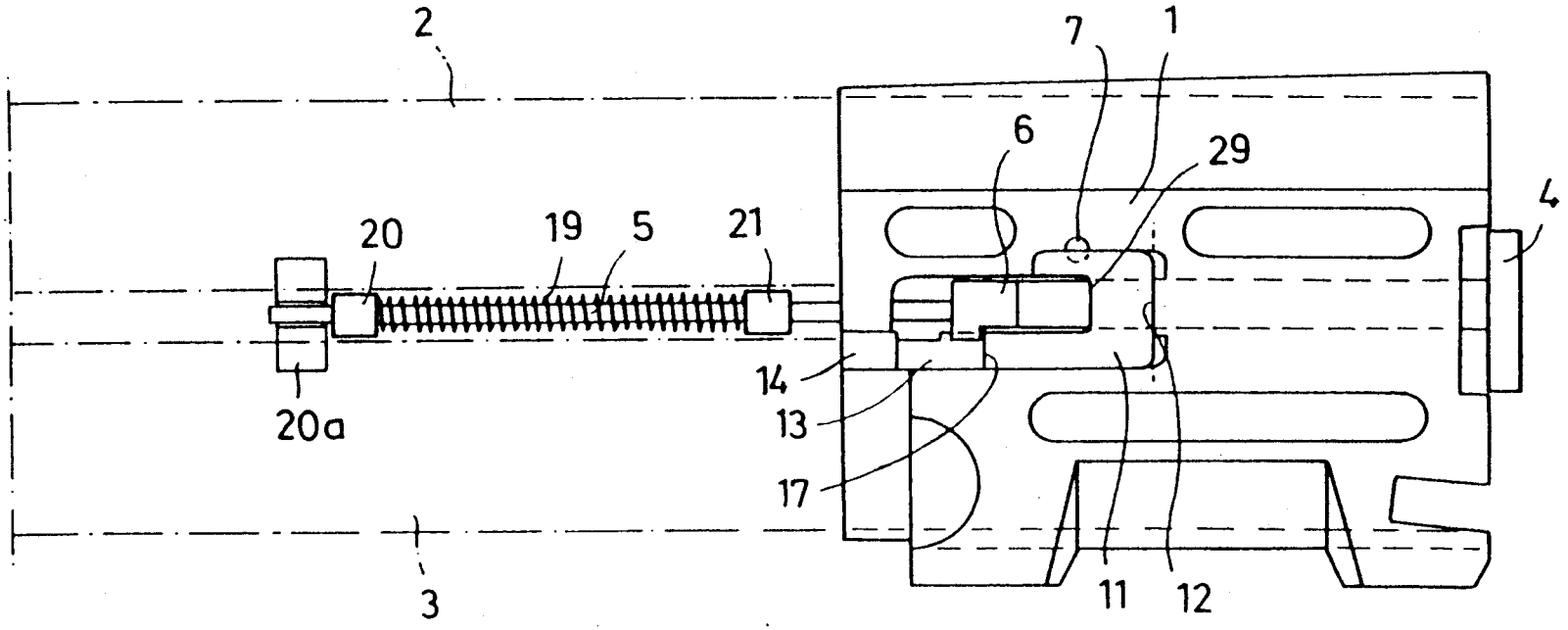
FIG. 2 shows a lateral view of the monobloc unit with only partially tilted barrels in the tensioned position of the cartridge ejection device.

FIG. 1 shows a monobloc unit 1 of a gun with two over and under barrels 2, 3 in the protruding position of the cartridge extractor 4. This position is always assumed when the barrel are completely broken open. If no shot has been fired, the cartridge extractor 4 holding the cartridge case will move, during tilting, gradually into this position in correspondence with the tilting motion, on account of the ejector spring 5 which is designed as a compression spring. If a shot has been fired, the cartridge extractor 4 locks into a tensioned position as shown in FIG. 2. Only when the barrels have been entirely tilted will the blockage of the cartridge extractor movement be eliminated. This is brought about by the feature that in a known manner the control flap 11 is urged inwardly by an extension in the region of the hinge of the breech casing and thus the detent 17 releases the cam 6. The impulses transmitted by the ejector spring 5 ejects the empty cartridge case.

The movement of the cartridge extractor 4 takes place via a cam 6 positively guided in the breech casing so that the cartridge extractor is guided, during tilting, from the protruding into the retracted position and, alternatively, during closing, from the retracted into the protruding position. In case of a double-barreled shotgun, such cams are provided on both sides of the barrels.

A control bolt 7 is countersunk into the wall of the barrel 2, the control bolt being shown in a sectional view in FIG. 3. The bolt comprises a shoulder 8 abutting against a corresponding edge in the barrel wall. As a result, the tip 9 of the control bolt 7, adapted to the cartridge case, does not extend too far into the barrel. An edge 10, produced by a milled portion on the other side of the control bolt 7, makes it possible for the control bolt 7 to rest on the control flap 11 whereby the bolt is secured against twisting and dropping out.

Figure 6A:
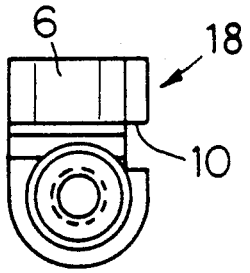
FIGS. 6A, 6B and 6C show three sectional views of the extractor element.
Figure 6B:
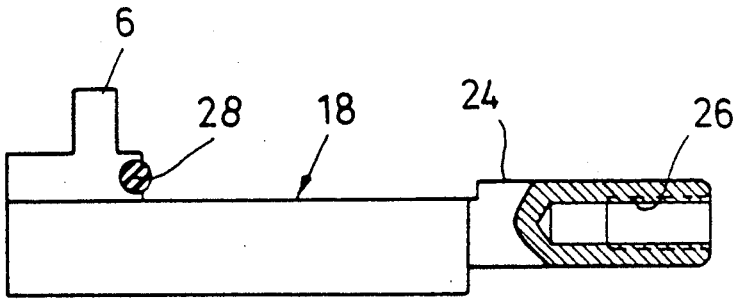
Figure 6C:
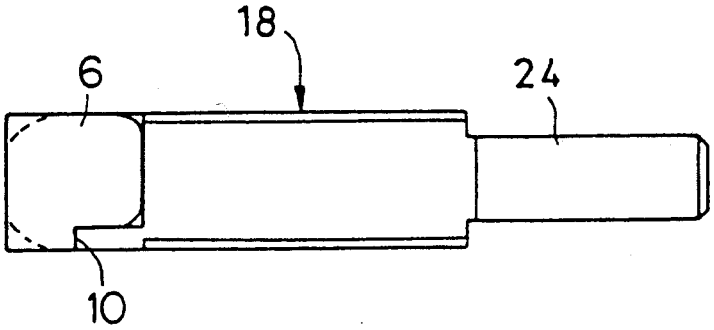

The control flap 11 is movable about an axis 12. The control flap is illustrated in FIG. 4. It has a longer arm 13. In case the control bolt 7 urges the control flap 11 somewhat away from the barrel (in the illustration of FIGS. 1 and 2 out of the plane of the drawing), the thus-evoked movement leads at the end 14 of the arm 13 to a movement enhanced with respect to the bolt movement. Connecting tangs 15 are provided on the control flap 11 which act, in conjunction with corresponding grooves 16 (FIG. 8) in the monobloc unit 1, as a hinge. The control flap 11 has a detent 17 corresponding with an edge at the cam 6 of the cartridge ejector device. As will be described below, the cartridge ejector is bipartite, and the cam 6 is attached to an ejector element (FIG. 6) in connection with the cartridge extractor 4 via a spring, but this is of no importance for the function of the detent.

With a barrel being entirely closed, the cartridge extractor 4 is urged into the monobloc unit 1 to a somewhat greater extent than illustrated in FIG. 2. The ejector spring 5 is maximally tensioned in this condition.

The ejector spring 5 is extended through a bolt 19 which, in turn, is held in a spring abutment plate 20*a* by a bushing 20 and is guided to be axially displaceable in a bore in the monobloc unit 1; the bolt 19 has a collar 21 facing toward the monobloc unit 1. This collar serves as a spring abutment, in the same way as the bushing 20.

The position of the collar 21 on the bolt 19 is determined so that, in the protruding position of the cartridge extractor 4, there remains still a certain amount of play for the cartridge extractor 4 (5–15% of the entire path). By the mounting of spacer rings between the collar 21 and the ejector spring 5, the spring force can be varied and thus the ejection range of the empty cartridge case can be altered.

In FIGS. 5A–B and 6A–C, the two parts of the cartridge ejector, the cartridge extractor 4 and the extractor element 18, are illustrated, of which the cartridge ejector is preferably constructed. The cartridge extractor 4 exhibits a cylindrical base member 22 permitting round guide means in the monobloc in the zone of the barrel ends. With such a design, it is also possible for the cartridge extractors 4 to be identical for the upper and lower barrels 2, 3. Securement against twisting of the cartridge extractors 4 is provided by the extractor element 18 illustrated in a sectional view in FIGS. 6A–C wherein the piece mounted on the right-hand side of the gun differs in structure from the piece mounted on the left-hand side of the gun (in the mirror-image fashion).

In the condition wherein the cartridge extractor 4 and the extractor element 18 are assembled, two mutually parallel surfaces 23, 24 are in contact with each other, thus ensuring that the extractor element 18, which is guided anyway in the zone of the cam 6, also secured the cartridge extractor 4 against twisting. In the illustration of FIG. 5A, a screw 25 is furthermore shown which can only engage into a thread 26 in the extractor element 18 but slides within the cartridge extractor 4. A spring 27 permits a differing axial movement of the cartridge extractor 4 and the extractor element 18. Thereby a reduction of stress peaks is attained. However, moreover, it is also ensured in a simple way that during closing of the firearm the cartridges are retracted in time and the cartridges do not rub along the breech casing. As soon as the cartridge extractor 4 has been retracted prior to the complete tilting of the barrels, the closing movement due to the spring 27 leads merely to a movement of the extractor element 18.

A damping element 28, e.g., in the form of a straightened part of an O ring is mounted to the cam 6 at the extractor element 18 in a bore thereof; this damping element brakes the impingement of the cam 6 against the surface 29 of the control flap 11.

Figure 7:
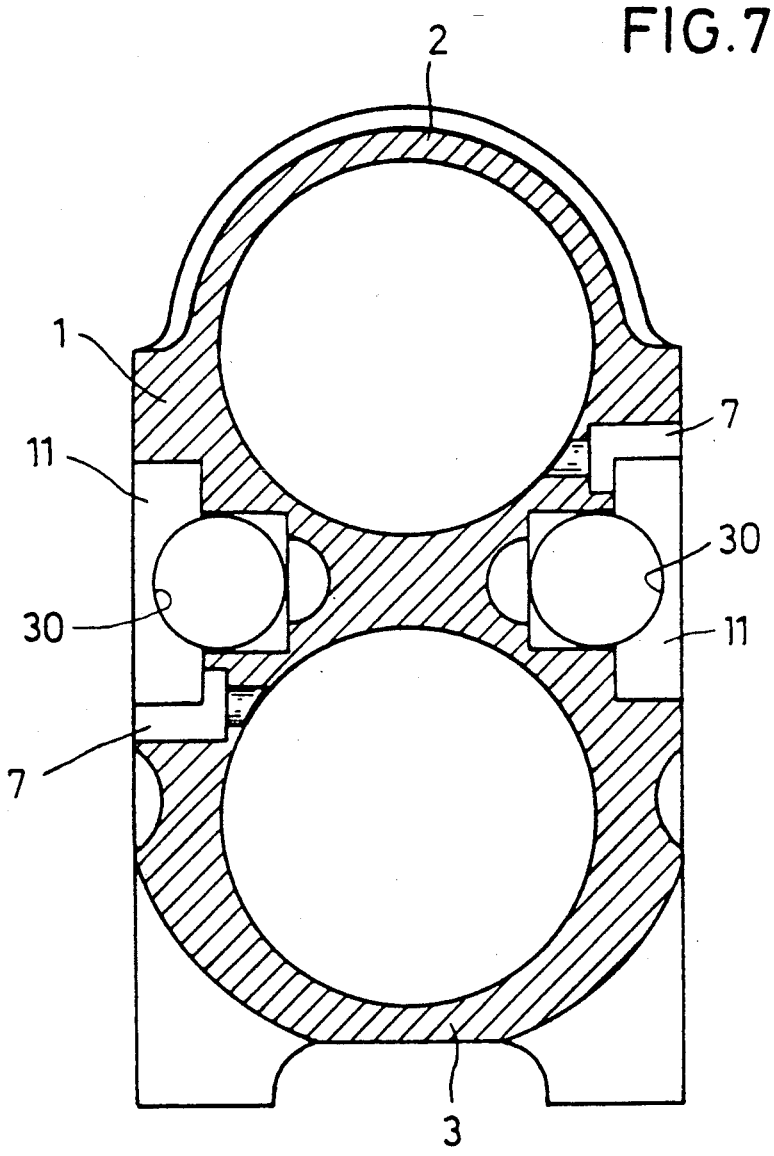
FIG. 7 is a section through the barrels of a double-barreled shotgun at the level of the control bolts.

FIG. 7 shows the cooperation of the control bolt 7 with the control flap 11. It can be seen, in particular, that the control of the cartridge extractor 4 by the control flap 11 is located on the outside at the monobloc unit 1 and thus is readily accessible. It can furthermore be seen that the cartridge extractor 4 can be guided in a round bore 30 in the monobloc unit 1 without weakening the monobloc unit 1 unduly.

Figure 8:
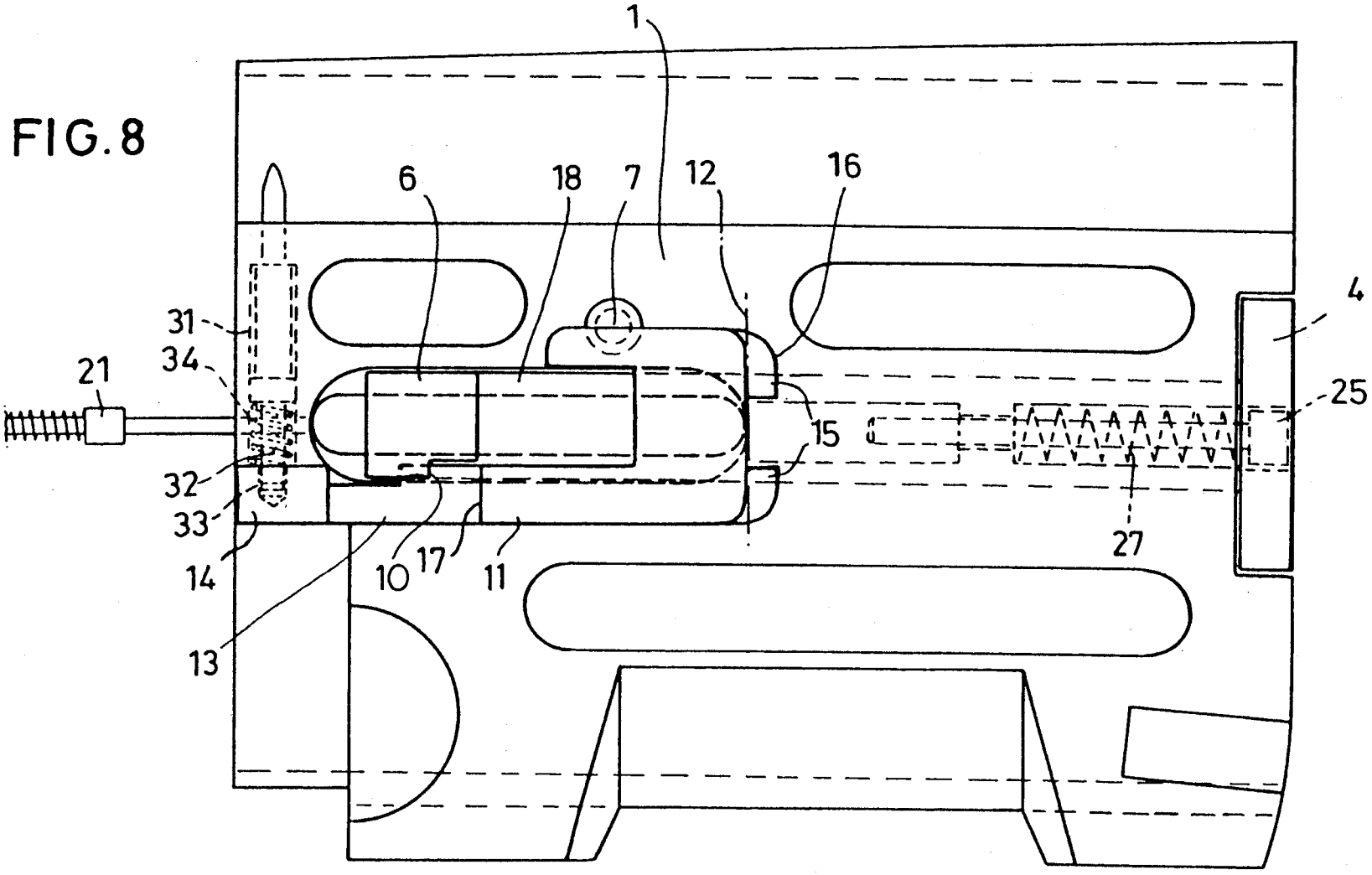
FIG. 8 is a view of a control flap with a means for blocking the automatic ejector mechanism.

The ejection device according to this invention is illustrated in FIG. 8 with an additional special feature. This figure shows the cartridge extractor 4, the extractor element 18, and the control flap 11 driven by the control bolt 7 and tiltable about the axis 12 wherein, in this position, the detent 17 on the control flap 11, oriented against the cam 6, blocks the movement of the cartridge ejector (tensioned position). A socket head screw 32 is inserted in a bore 31 in the monobloc unit 1 equipped with a thread; this screw can be threaded in place to such an extent that its tip reaches into a bore 33 at the end 14 of the longer arm 13 of the control flap 11. Thereby, a tilting motion of the control flap 11 about the axis 12 by means of the control bolt 7 into the tensioned position is prevented. Such a simple deactivating possibility desirable but heretofore has not been realizable in conventional firearms, for reasons of space alone.

Furthermore, the screw 32 makes it possible to vary the mobility of the control mechanism. In correspondence with EP 103,568 B1, the control bolt 7 is to be "sluggish". Such a condition is hard to meet and also is difficult to maintain over a relatively long period of time. In the device according to this invention, the sluggishness can also be taken over by the control flap 11, being the element that transmits and reinforces the bolt movement.

Concretely, the movability is altered, for example, by the pressure of a spring 34 which can be urged by the screw 32 with greater or lesser force onto the longer arm 13 of the control flap 11.

Triggering of the tensioned position with empty cartridge cases toward the end of the tilting step is effected by means of a projecting surface at the breech casing which presses the control flap 11, somewhat projecting from the monobloc unit 1, toward the barrel; as a consequence, the bolt 7 can slide over the detent 17 on the control flap 11 and quickly relaxes the ejector spring 5.

What is claimed is:

1. A break-open firearm having with at least one barrel and a cartridge ejection device in a monobloc unit, comprising per barrel a cartridge ejector movable in the barrel direction, said cartridge ejector, during tilting of the at least one barrel, being movable via a cam and by a corresponding guidance of the cam in a breech casing from a retracted position into a protruding position, and performing, during straightening of the at least one barrel, a reverse movement wherein, during straightening, an ejector spring can be tensioned at the same time, and, per barrel, a control bolt is provided extending through a barrel wall and effecting, after a shot has been fired, that the cartridge ejector during tilting remains in a tensioned position, and the tensioned position can be abolished only when the at least one barrel has been entirely tilted, characterized in that a control flap with a detent is provided which is mounted to the outside of the monobloc unit, that the control flap can be moved about an axis transversely to the barrel direction, the control bolt not being in engagement with the cartridge ejector but rather, after a shot has been fired, lifting the control flap so that, with the control bolt in the extended position, the detent on the control flap abuts against an edge on the cartridge ejector and thereby the cartridge ejector initially remains in the tensioned position during further tilting of the at least one barrel whereas, when the control flap is not extended, the movement of the cartridge ejector is not impeded.

2. A break-open firearm according to claim 1, characterized in that the cartridge ejector is of a bipartite structure, made up of a cartridge extractor and an extractor element.

3. A break-open firearm according to claim 2, characterized in that the cartridge extractor and the extractor element are coupled elastically by way of a spring so that the path of the cartridge extractor can be identical to or shorter than the path of the extractor element positively guided by the cam.

4. A break-open firearm according to claim 1, characterized in that the cartridge extractor is annularly guided and is secured against twisting by an arrangement wherein it is in contact with a longitudinal surface against a corresponding longitudinal surface of the extractor element.

5. A break-open firearm according to claim 1, characterized in that at least two barrels are provided, and the cartridge extractors for each barrel are identical.

6. A break-open firearm according to claim 1, characterized in that means are provided for enabling a varying of the effect of the ejector spring on the cartridge ejector along the final portion of the path of the cartridge ejector in a protruding position.

7. A break-open firearm according to claim 1, characterized in that the ejector spring is damped.

8. A break-open firearm according to claim 1, characterized in that the control flap is guided by means of connecting tangs in grooves in the monobloc unit.

9. A break-open firearm according to claim 1, characterized in that a tap bolt accessible from the outside is provided at the monobloc unit and is cooperable with a portion of the control flap so as to prevent a movement of the control flap by the control bolt.

10. A break-open firearm according to claim 1, characterized in that a compression spring is provided which exerts pressure on the control flap in the lateral direction.

* * * * *